US005281067A

United States Patent [19]

Ward et al.

[11] Patent Number: 5,281,067

[45] Date of Patent: Jan. 25, 1994

[54] POLE INSTALLATION GUIDE

[75] Inventors: Fred A. Ward, Houston; Terry G. White, Highlands; Clyde D. Loll, Deer Park; Charles C. Juarez, Houston, all of Tex.

[73] Assignee: Houston Industries Incorporated, Houston, Tex.

[21] Appl. No.: 943,042

[22] Filed: Sep. 10, 1992

[51] Int. Cl.[5] ..... B66F 9/00

[52] U.S. Cl. ..... 414/23; 52/298; 52/169.13; 52/749

[58] Field of Search ..... 414/23; 52/127.2, 169.13, 52/749, 750

[56] References Cited

U.S. PATENT DOCUMENTS

| | | | |
|---|---|---|---|
| 594,894 | 12/1897 | Nylander | 223/118 |
| 608,193 | 8/1898 | Gordon | 414/23 |
| 1,317,816 | 10/1919 | Nyrop | 414/23 |
| 1,690,516 | 11/1928 | Wickers | 223/118 |
| 2,138,842 | 12/1938 | Drew | 414/23 |
| 2,725,991 | 12/1955 | Maenpaa | 414/23 |
| 4,598,512 | 7/1986 | Chapman | 405/232 |
| 5,020,605 | 6/1991 | Leishman | 405/232 |

FOREIGN PATENT DOCUMENTS

| | | | |
|---|---|---|---|
| 318876 | 3/1919 | Fed. Rep. of Germany | 223/118 |
| 1012739 | 6/1955 | Fed. Rep. of Germany | 414/23 |
| 8541V37 | 7/1956 | Fed. Rep. of Germany | 52/298 |
| 53524 | 2/1954 | Norway | 414/23 |
| 6705 | 3/1893 | United Kingdom | 223/118 |

*Primary Examiner*—Michael S. Huppert
*Assistant Examiner*—Gregory A. Morse
*Attorney, Agent, or Firm*—Pravel, Hewitt, Kimball & Krieger

[57] ABSTRACT

The invention provides a pole installation guide for the installation and removal of large poles, such as utility poles. The guide includes an elongate guide body with a curved surface adapted for receiving and slidingly engaging poles for insertion into a receiving hole. The guide body has an upper portion extending above the hole and a lower portion extending into the hole. Intermediate the upper and lower portions is located a ground plate, preferably equipped with spikes for engaging the ground surface, for supporting and retaining the guide body in place when the installation guide is in use.

1 Claim, 5 Drawing Sheets

POLE INSTALLATION GUIDE

BACKGROUND OF THE INVENTION

1. Field of the Invention

This invention relates to a guide apparatus that may be use for installing generally cylindrical structures into a prepared hole in a substrate. More particularly, the invention guide is suitable for guiding a large pole, such as a utility pole, into a prepared hole in a ground surface.

2. Description of the Related Art

The efficient and safe installation or removal of large poles, such as utility poles, has long presented a challenge to those persons routinely engaged in this endeavor. For example, U.S. Pat. No. 608,193 which issued in 1898 disclosed a derrick for installing telegraph poles. The structure disclosed included a suitable mast adapted to be placed in the hole; an I-beam for guiding the lower end of the telegraph pole into the hole; and a derrick structure for raising or lowering the pole. The I-beam used to guide the lower or butt end of the pole into the receiving hole was equipped with a protruding V-shaped bar. Since telegraph poles were typically wooden, the butt end of the wooden pole would ride during installation against the V-shaped bar, causing a groove to form in the pole around the V-shaped bar. Thus, the V-shaped bar and cooperating groove in the pole would act to stabilize the telegraph pole while it was being inserted into the ground.

For elongate telegraph or utility poles, the possibility of swaying pole movement while suspended by a lifting mechanism during installation or removal was always present. There was, thus, a possible danger that sideways or swaying movement of the pole, while it was being lifted or failure of the wood surrounding the groove could dislodge the pole from the V-shaped bar. This would cause the pole to move away from the I-shaped guide beam. If the pole was partly in the hole, it would gouge into the side of the receiving hole. This would then necessitate the laborious process of removing the pole, emptying the hole of dislodged earth, repairing the hole, resetting the apparatus, and restarting the telegraph pole raising operation. Further, the use of the V-shaped groove forming bar as a guide for lowering telegraph poles would clearly not be suitable if the poles were fabricated from metal.

Subsequently, other approaches have typically used a flat board or plate as a guide for inserting poles into holes in the ground. For example, U.S. Pat. No. 2,138,842 discloses a pole-setting device which could be attached to the front end of a truck so that forward movement of the truck raised the pole. To guide the pole into the receiving hole, a flat board was placed in the hole so that the butt end of the pole slid against and down the length of the board when the pole was being inserted into the hole. A board used in a similar manner was shown in U.S. Pat. No. 2,725,991. However, in practice, when wooden boards were used with modern large utility poles, the boards would often fracture or the pole slide from the flat surface of the board and gouge or damage the sidewall of the hole. This required removal of the pole, frequently by manual operation, thereby increasing the risk of injury to workers and causing costly time delays in pole erection.

There is thus a need for a pole installation guide that reduces the risk that the butt end of a pole would move or sway and gouge the sidewall of the hole, that would not tend to break under the weight of a large utility pole, and yet that would be sufficiently light in weight and simple to use, and inexpensive to fabricate.

SUMMARY OF THE INVENTION

Briefly, the invention provides a pole installation guide for installing and removing large poles, such as utility poles. The pole installation guide of the present invention has a body member with an arched longitudinal surface for receiving the end of a pole, often referred to as the butt end, to be inserted in a hole. The body member guides the pole into a prepared hole, thereby reducing the risk of the pole moving sidewardly and gouging into the sidewalls of the hole. Further, the pole guide apparatus of the present invention is lightweight, simple to construct, and easy to use in relatively confined spaces. The pole installation guide according to the present invention is also inexpensive to fabricate and may be made from a range of materials, depending upon its intended application.

The pole installation guide of the present invention includes an elongate body portion with an arched or curved surface for receiving and guiding the butt end of a pole. The body portion is designed so that a portion extends above the ground while the remainder extends into the receiving hole. The above-ground portion prevents the pole from sliding or moving past the guide upon initial above ground engagement of the pole butt end with the guide body. The arched elongate body portion is equipped with a suitable means for supporting, such as braces or struts affixed to the portion extending above the ground and extending downward to a horizontal, ground engaging support plate.

The ground engaging plate rests on the surface of the ground surrounding the hole to ensure that the guide body is properly positioned in the hole for contact with the pole butt end. The support plate is equipped with ground engaging spikes or cleats to ensure firm ground engagement and support of the guide during use. Additionally, a carrying handle or bar may be included, typically at the upper ends of the struts near the top of the guide, to facilitate carrying and handling movement of the guide to and from a job site.

During use, the guide body is first inserted into the hole at the desired location on the opposite side of the direction of approach of the pole for insertion. The butt end of the pole is then brought into contact with the upper, above ground end of the guide. As the pole is lifted and tilted, the butt end of the pole rides against the arched surface of the guide body and is guided into the receiving hole without damaging the earthen walls of the hole.

The pole installation guide of the present invention is particularly useful in cases where a service pole cannot be installed by a derrick digger and must be installed by hand. However, it may also be used in conjunction with a derrick digger and will minimize the risk of damage to the hole, with consequent lost time and expense incurred when a hole has to be reworked.

Figure 1:
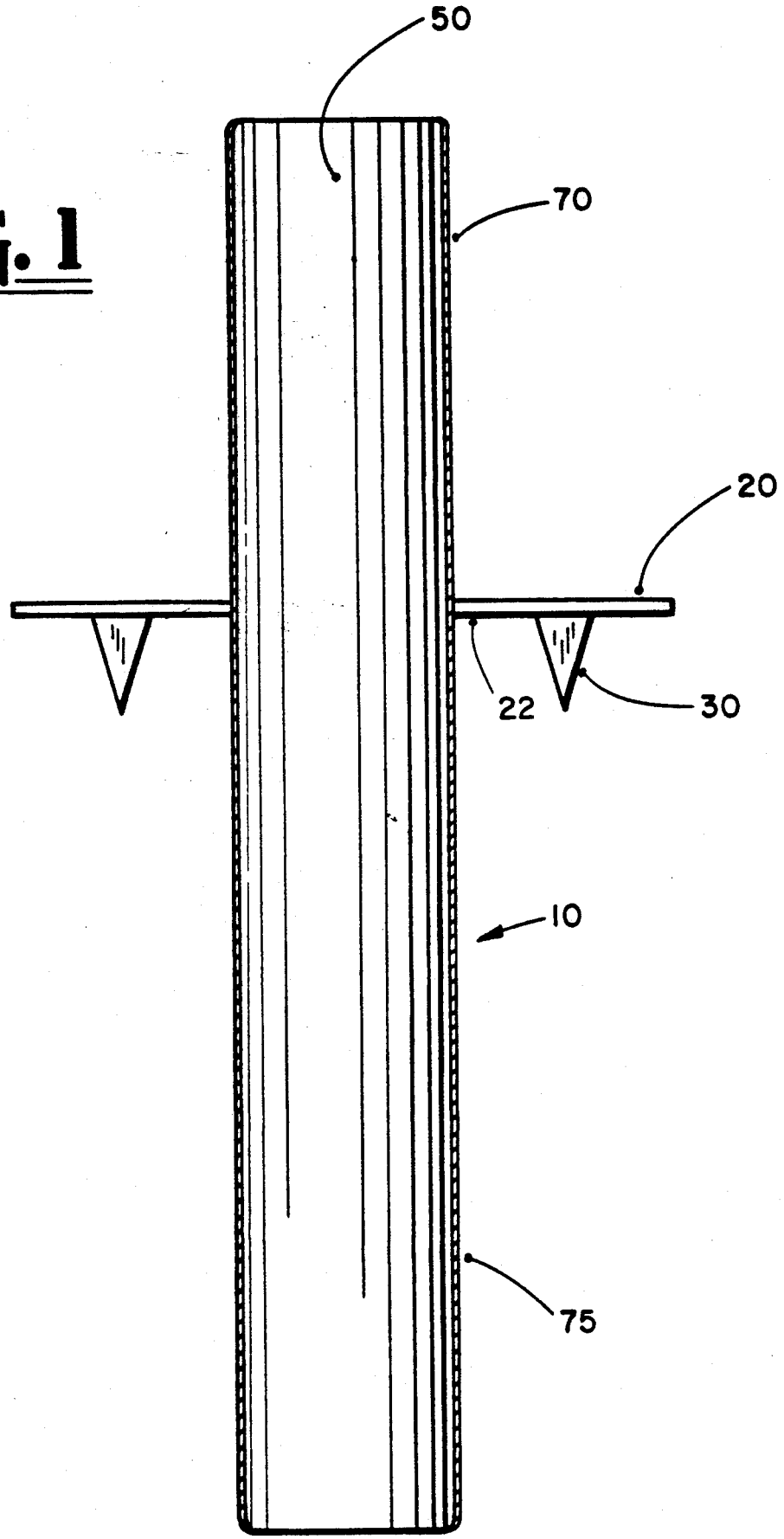
FIG. 1 is a front elevation view, taken partly in cross-section, of a pole installation guide according to the present invention.
Figure 2:
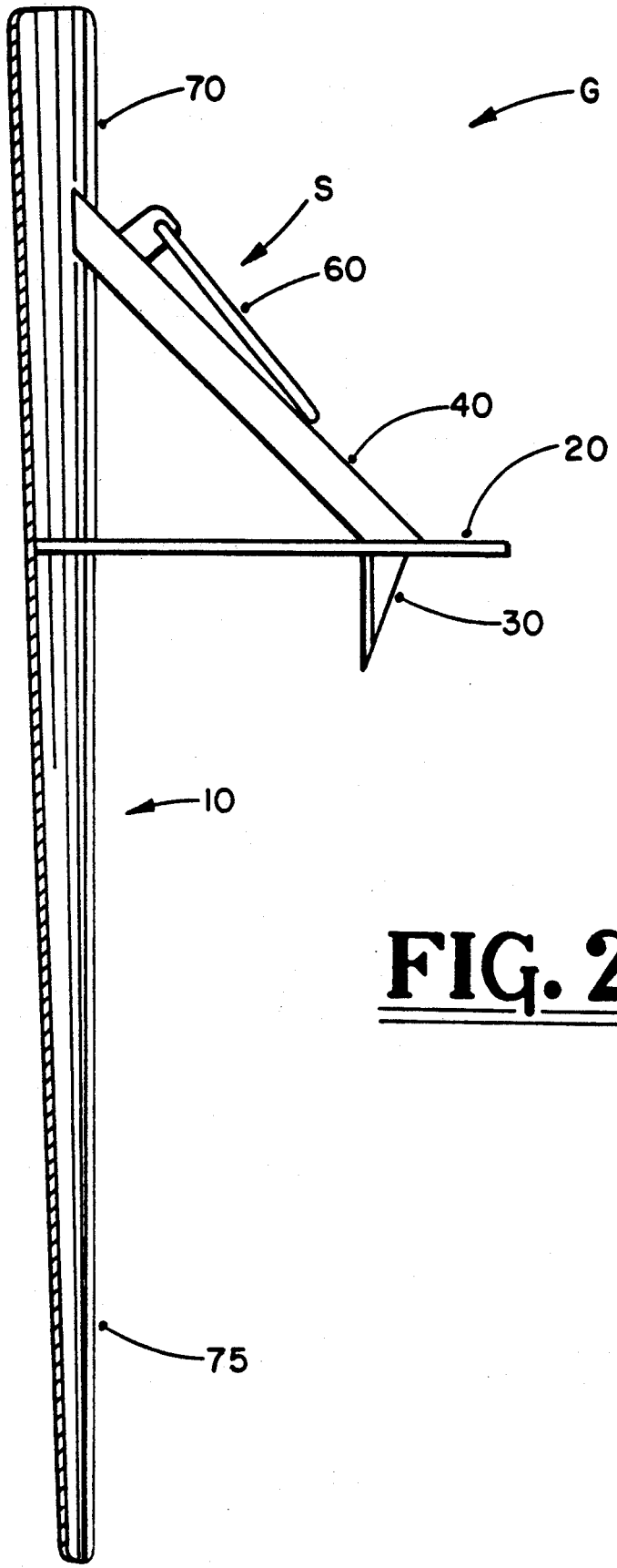
FIG. 2 is a side elevation view, taken partly in cross-section, of the pole installation guide of FIG 1.
Figure 3:
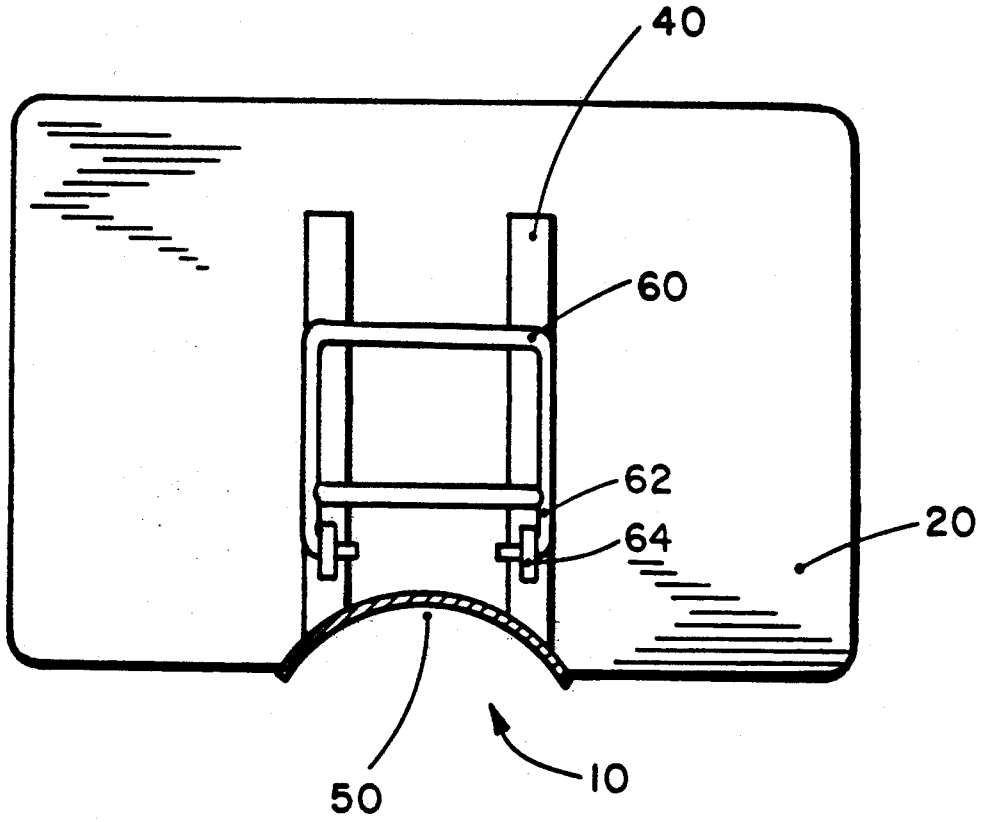
FIG. 3 is a plan view, taken partly in cross-section, of the pole installation guide of FIG. 1.

In order to facilitate understanding of the invention pole installation guide, reference will be made to the accompanying figures, it being understood that the figures represent preferred embodiments and do not define the entirety of the scope of the invention as hereafter described and claimed.

DESCRIPTION OF THE PREFERRED EMBODIMENTS

In the drawings, a pole installation guide G according to the present invention is shown. The pole installation guide G has an elongate guide body 10 which is in the form of a curved longitudinally extending wall member having a curved or arched inner surface 50. The surface 50 is for receiving, slidingly engaging and guiding a butt end B of a pole P into a hole H formed in a substrate 12, usually a ground surface. The guide body 10 includes an upper portion 70 that extends above the hole H and the ground surface 12. The body member 10 also has a lower portion 75 for inserting into the hole H. Further, the guide body 10 is equipped with a support means S for supporting the guide body 10 and retaining the upper portion 70 of the guide body 10 in proper position with respect to the hole H during insertion or removal of the pole P.

The elongate body member or portion 10 is supplied with an arched or curved longitudinally extending inner surface 50 for receiving and guiding poles into the receiving hole H. The upper portion 70 of body member 10 extends above the support means S to stabilize the guide body 10. The support S thus functions for supporting and retaining the guide body 10 in place.

The support S may be any suitable support structure and thus includes a ground engaging plate 20 affixed to a rear surface 50*a* of the guide body 10 by struts, braces or the like 40. The ground engaging plate 20 is typically a flat, rectangular member for the purposes of load distribution and weight transfer and is mounted on the guide body 10 between the upper section 70 and the lower portion 75.

An undersurface 22 of the ground engaging plate 20 is equipped with several suitable ground engaging members or spikes 30. The ground engaging members may also be teeth, cleats, or ridged or knurled surfaces or other suitable members to provide firm ground engagement for the guide G and preventing slippage or movement during use.

The installation guide G may also be fitted with a handle 60, preferably mounted at or near the upper end 70 of the guide body 10. The carrying handle 60 may be either movably or fixedly attached to the remainder of the guide body G. The carrying handle 60, for example, is pivotally attached at upper ends 62 of a pivotable yoke or handle bar 64 to a pair of connector tabs or attachments 64. The connector tabs 64 are formed on the strut members 40 at a suitable point intermediate the upper end 70 of the guide body 10 and the support plate 20.

The elongate arched guide body 10 is fabricated from a suitable material to withstand the weight of the pole P during installation or removal, depending on the size and weight of the pole. Thus, when large or heavy wood utility poles or heavy metallic poles are installed, then it is desirable that the guide body 10 be fabricated from steel or other material of suitable strength. Where on the other hand, lighter poles are installed, the guide body may be fabricated from a range of suitable materials, including aluminum, lightweight composite materials, and the like. The guide body 10 is preferably fabricated from as lightweight a material as is able to bear the weight of the pole without failure and that is yet able to withstand the rigors of long term use.

The curved or arcuate inner surface 50 of guide body 10 typically extends over a curved segment approximately conforming to that of a portion of the curved circumferential inner wall of the hole H. The inner surface 50 may, for instance approximate from as much as about one-half or 180°, to one-third, or 120° down to about one-sixth or 60° of the circumference of the hole H into which the pole is to be inserted. In some situations, it is preferable to have the inner surface 50 extend about one-fourth, or 90°, of the circumference of the hole H.

The guide body 10 may be formed with the upper portion 70 and lower portion 75 tapering into a generally wedge-shaped configuration, as shown, for ease of insertion into and removal from the hole H.

The upper portion 70 and lower portion 75 may also be of the same circumferential size through the longitudinal extent of the guide body 10 from its top to its bottom, if desired.

Figure 4B:
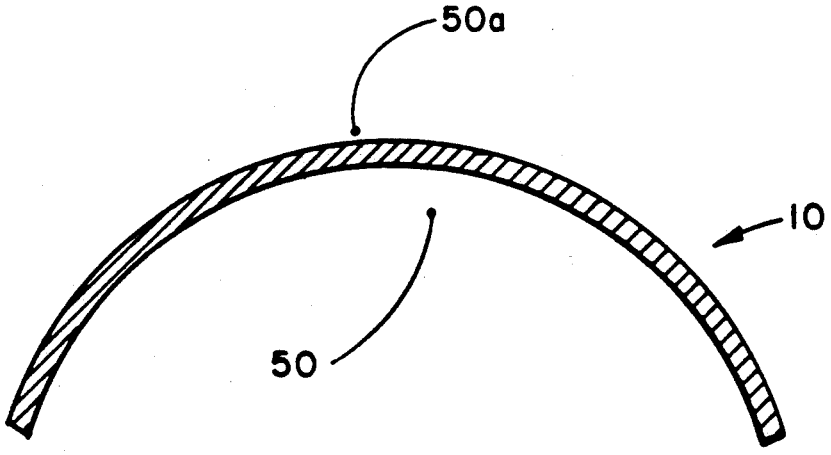
FIG. 4B is a cross-sectional view of an alternative embodiment of a guide body to that of FIG. 4A.
Figure 4A:
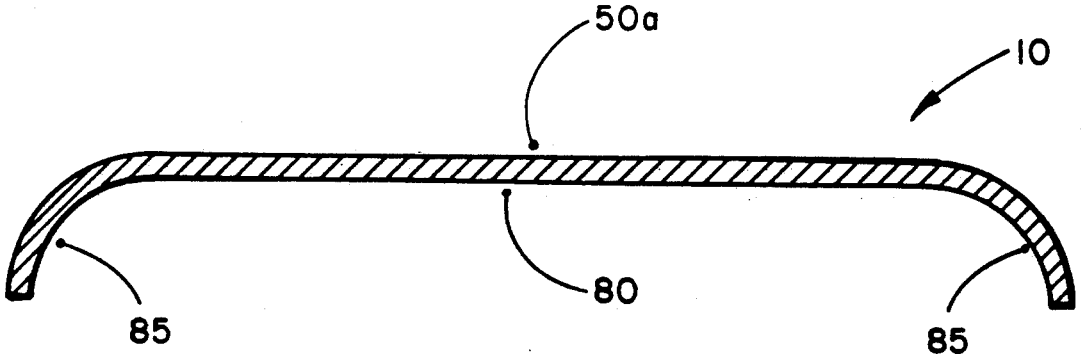
FIG. 4A is a cross-sectional view of an embodiment of a guide body of the pole installation guide of FIG. 1.
Figure 5:
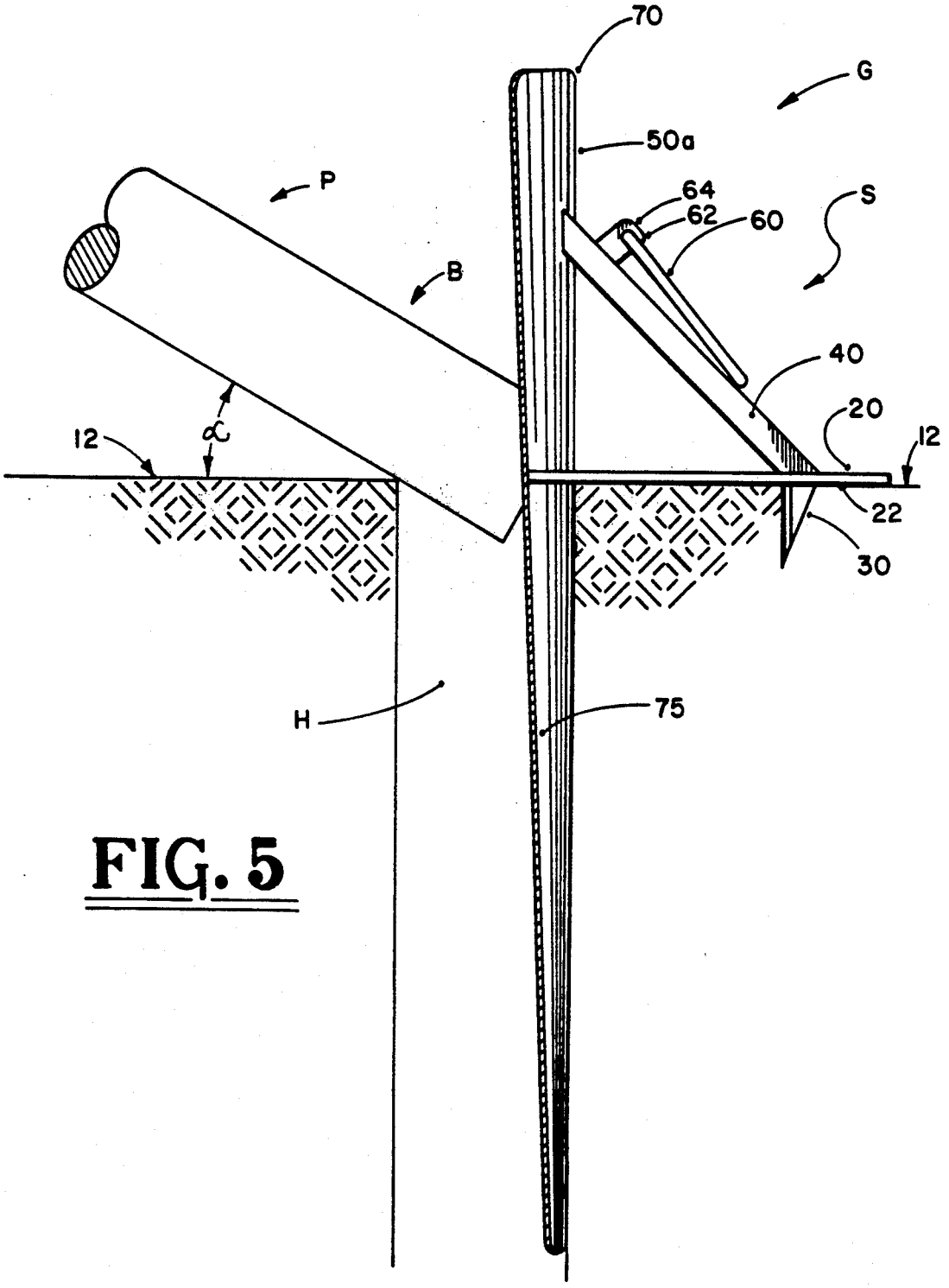
FIG. 5 is an elevation view, partly in cross-section, of the pole installation guide of FIG. 1 in use.

Alternatively, in certain situations, the guide body 10 may have a generally flat center wall portion 80 with inwardly curving ends 85, as shown in FIG. 4A. This shape can also perform the function of receiving the butt end 8 and guiding the pole P into a hole while minimizing the risk of slippage of the pole P from the guide surface 50. Therefore, it should be understood that the shape of surface 50 is not restricted to a segment of the circumference of a circle defining the hole, but may include any non-planar curved shape that can receive, slidingly engage and guide the insertion of the butt end of the pole P into the hole H. This function is performed while reducing the risk that the pole P will slip from the surface of the guide body 10. Such a surface is herein referred to for the purposes of the present invention as "an arched or curved surface."

As one specific example, an installation guide G for electrical utility poles P, which are typically of length from about twenty-five to about thirty feet and diameter of about 10 inches, would typically have an upper elongate body section 70 extending from about 12 inches to about 18 inches above the ground plate 20 to provide a firm stopping anchor for the butt end B of the pole P. The lower portion 70 of the guide body 10 would in this situation range in length from about 30 inches to about 45 inches or deeper to extend into the hole H. The ground plate 20 would then measure approximately 24 inches by 16 inches and be equipped with ground-engaging spikes 30 that are about 3 inches to about 6 inches long to provide secure engagement with the ground surface.

In using the invention installation guide G for installing a pole P, the guide G is placed in the hole H at a location opposite the butt end B. The pole P is then moved longitudinally along the ground surface until butt end B is brought into engagement with the arched surface 50 of the guide body 10. The pole P is then lifted by hoist, hand or other suitable lifting technique upwardly through an angle $\alpha$ thereby causing the butt end B of the pole 100 to pivot and to slide downwardly along the surface 50 of the guide body 10 and into the hole H.

The horizontal component of the load of the pole P present at the butt end B is spread by the installation guide G over the surface of the wall of the hole H covered by the guide body end 75 rather than being localized. The installation guide G also will better receive the impact of any sudden movement of the pole P than would the earthen walls of the hole H.

The guide body is supported by a structure including braces or struts 40 and ground plate 20 equipped with ground engaging spikes 30, as explained above. Thus, as the angle $\alpha$ increases up to 90°, the butt end of pole 100 is guided into the hole by guide body 10, thereby avoiding potential slippage of the pole and insuring secure, safe and efficient erection of the pole P. The installation guide G may also be used as a safety aid when removing a pole P. In some situations, the pole P may tend to swing pendulum-like when the butt end B comes out of the hole H. The installation guide G may be inserted into the hole H along the pole P. The upper end portion 70 of the guide body 10 then serves to limit any such swing or undesirable pole movement.

Having described the invention above, various equivalents and modifications of the techniques, procedures, material and equipment will be apparent to those in the art. It is intended that all such variations within the scope and spirit of the appended claims be embraced thereby.

We claim:

1. A pole installation guide comprising:

an elongate guide body having a rear surface and an arched surface for receiving, slidingly engaging, and guiding a but end of a pole being inserted into a hole surrounded by a surface, the guide body comprising:

(1) an upper portion for engaging the butt end of the pole above the surface, and (2) a lower portion extending into the hole and guiding the butt end of the pole below the surface;

a ground plate intermediate the upper and lower portions of the guide body and adjacent the rear surface of the guide body, the plate being in contact with the surface surrounding the hole when a pole is being guided to support the guide body;

ground engaging means extending downward from the plate for engaging the surface surrounding the hole and anchoring the guide in place;

wherein the guide body arched surface is a cross-sectional shape conforming to the pole and the hole into which the pole is being installed; and wherein the arched cross-section of the guide body has a centrally located, substantially flat portion of finite width having ends curved inwardly to engage and guide a pole for installation.

* * * * *